United States Patent [19]

England et al.

[11] Patent Number: 4,610,317

[45] Date of Patent: Sep. 9, 1986

[54] SPHERICAL BIT

[75] Inventors: John R. England, Sudbury; Donald A. Desjardins, Garson, both of Canada

[73] Assignee: Inco Limited, Toronto, Canada

[21] Appl. No.: 707,703

[22] Filed: Mar. 4, 1985

[30] Foreign Application Priority Data

Mar. 19, 1984 [CA] Canada ..... 449916

[51] Int. Cl.[4] ..... E21B 10/08

[52] U.S. Cl. ..... 175/331; 175/350

[58] Field of Search ..... 175/331, 337, 338–340, 175/350–352, 327, 69

[56] References Cited

U.S. PATENT DOCUMENTS

| | | | |
|---|---|---|---|
| 191,241 | 5/1877 | Kimball | 175/331 |
| 1,124,242 | 9/1915 | Hughes | 175/350 |
| 1,195,208 | 8/1916 | Griffin | 175/350 |
| 3,924,695 | 12/1975 | Kennedy | 175/69 |

FOREIGN PATENT DOCUMENTS

| | | | |
|---|---|---|---|
| 2132662 | 7/1984 | United Kingdom | 175/331 |
| 1051209 | 10/1983 | U.S.S.R. | 175/350 |

*Primary Examiner*—Stephen J. Novosad
*Assistant Examiner*—Thuy M. Bui
*Attorney, Agent, or Firm*—Edward A. Steen; Raymond J. Kenny

[57] ABSTRACT

A rotary bit having a pair of semi-spheres rotating about a shaft extending from a center tongue. The semi-spheres include a plurality of cutters arranged in a predetermined fashion to maximize cutting efficiency. The semi-spheres may be disposed slightly off-center from the bit's axis of symmetry to bias the bit in a particular direction.

6 Claims, 6 Drawing Figures

SPHERICAL BIT

TECHNICAL FIELD

The instant invention relates to earth drilling in general and more particularly to a drill bit.

BACKGROUND ART

Rotary drill bits may be broadly classified into two categories: (1) drag and (2) rolling cutter. Drag bits tend to wear out quickly when used in hard rock formations. For example, our experience has been that when drilling a 6½ inch (16.51 cm) diameter hole with a drag bit and a percussion hammer for about 100 feet (30.5 m) in very hard rock, the carbide inserts on the drag bit quickly become badly worn with the diameter of the bit being reduced to 6⅜ inches (16.19 cm.). A new 6½ inch replacement bit cannot be used since it would destroy itself in the narrower hole. A smaller diameter bit will cause deviation problems in the hole since the new bit will, most likely, not properly center itself. Moreover, it is expensive and oftentimes impossible to have on hand replacement bits having differing sizes to accomodate various drilling contingencies.

A rolling cutter bit (also called a bicone or tricone bit), originally developed for oil well drilling suffers from penetration problems after too much wear. These bits fail in the presence of very hard rock. Although their accuracy is satisfactory, oftentimes these bits fail because their small bearings cannot cope with the extraordinary high stresses experienced by the bit within the hole.

In short, current bit designs have short lifetimes; their wear patterns result in tapered holes; and worn bits cause hole inaccuracies. As a result of these difficulties, the cost per foot of drilled ground is high. The drilling industry is continuously seeking means for lowering the costs associated with drilling.

SUMMARY OF THE INVENTION

Accordingly, there is provided a spherical rotary bit which: increases drilling efficiency; reduces drilling costs; and has a longer useful life. Accordingly, with a longer effective life, the bit may be replaced less often. Similarly, hole diameter and accuracy are maintained for greater periods of time.

The bit includes two cutting spheres revolving about a shaft extending from a central body. Heavy-duty bearing means are disposed between the shafts and the spheres. The body includes journals to supply air and oil to the bit and to free up the cuttings away from the bit.

PREFERRED MODE FOR CARRYING OUT THE INVENTION

Figure 1:
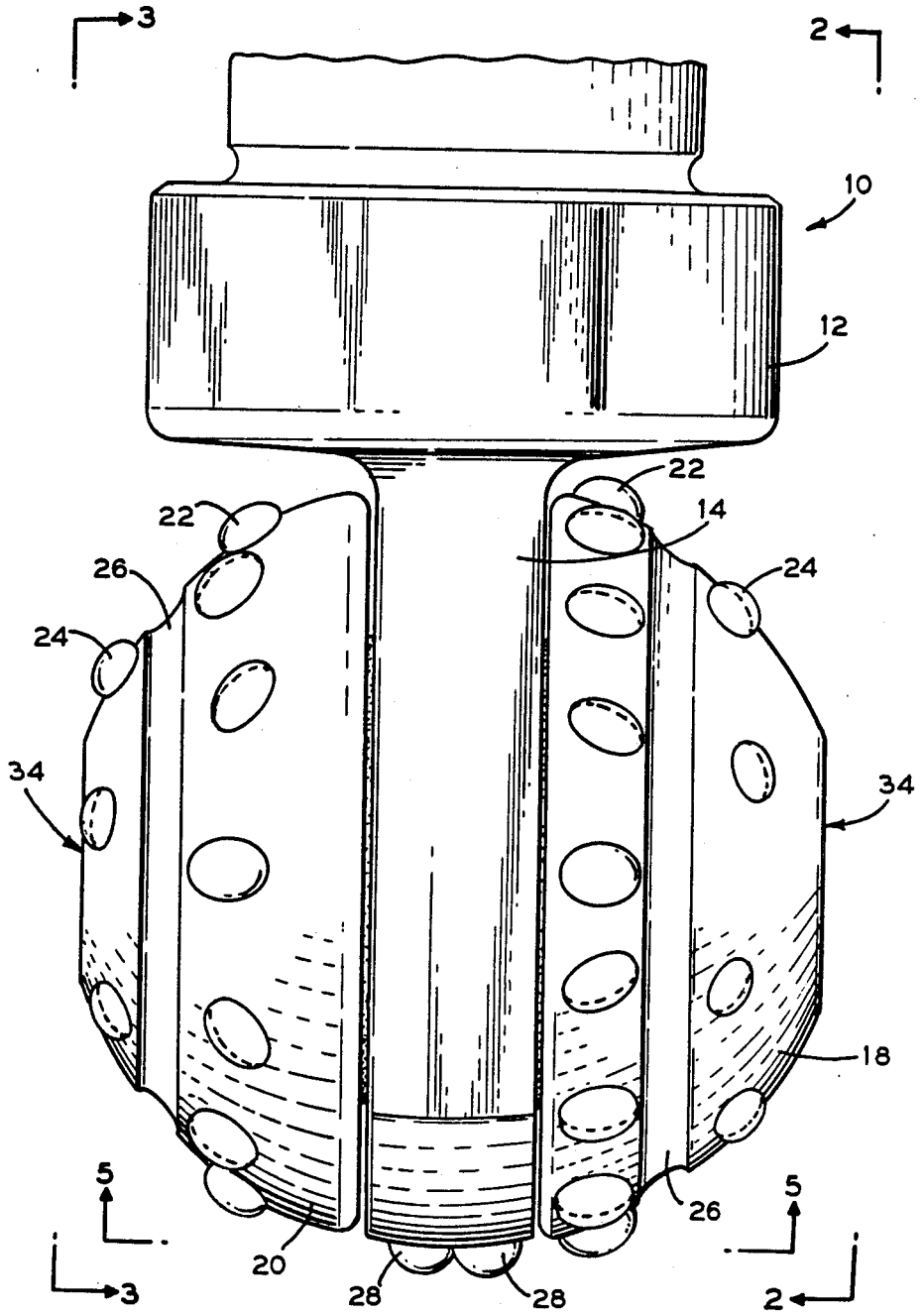
FIG. 1 is a front elevation of an embodiment of the invention.
Figure 4:
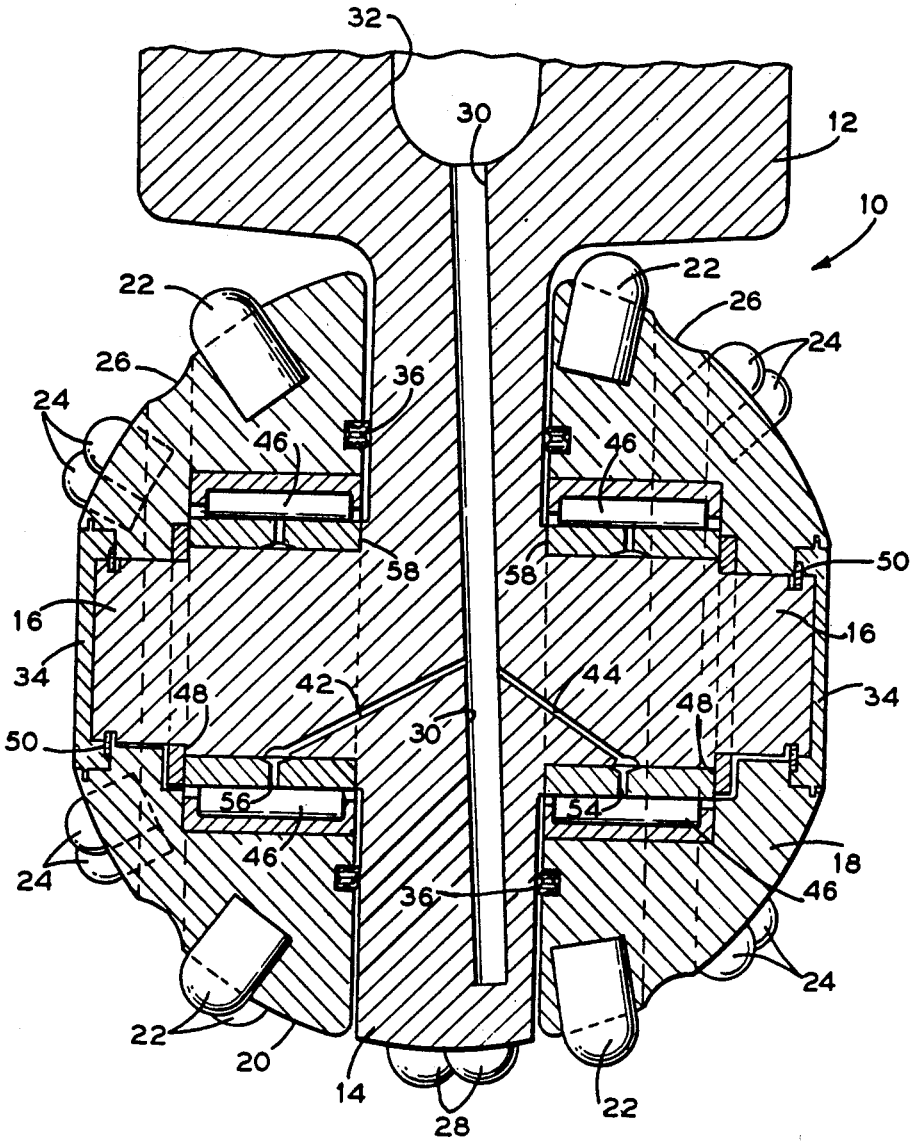
FIG. 4 is a view taken along line 4—4 in FIG. 3.

Referring to FIGS. 1 and 4, there is shown a front view and a cross-sectional view of spherical bit 10. The bit 10, made from a sufficiently strengthened material (i.e. hardened steels), includes shank 12, tongue 14, shaft

16 and semi-spheres 18 and 20. The semi-spheres 18 and 20 rotate about the shaft 16 and are each studded with an unequal number of dissimilarly sized, staggered cutters 22 and 24. Grooves 26 circumscribe the semi-spheres 18 and 20. Oilers 42 and 44 branch off central journal 30 and pass through the shaft 16 to make contact with passages 54 and 56.

In the embodiment shown, a pair of roller bearings 46 allow the two semi-spheres 18 and 20 to rotate about the shaft 16. Inner races 58 are disposed between the shaft 16 and the bearings 46. As an alternative to the bearings 46 and races 58, hardened carburized bushings (not shown) may be utilized to allow the semi-spheres 18 and 20 to rotate about the shaft 16. Thrust washers 48 prevent the races 58 from shifting out of position and reduce wear on the rotating parts. Retaining rings 50, seals 36, and end caps 34 protect and seal the innards of the bit 10 from the ravages of the drilling environment.

The tongue 14 includes cutters 28 disposed at the base thereof and the central journal 30. The central journal 30 communicates with oil reservoir 32. The shank 12 includes a fitting (not shown) for attachment to a drill rod (not shown).

In the embodiment shown, semi-sphere 18 includes a greater number of cutters 22 and 24 than does semi-sphere 20. Furthermore, although the cutters 22, 24 and 28 are in the form of carbide buttons, it may be appreciated that other cutter shapes (i.e. teeth, jagged edges etc.) and materials (i.e. diamond) may be utilized as well. Note also that the cutters 22 and 24 are staggered across the face of the semi-spheres 18 and 20. Spacing the cutters 22 and 24 in this fashion improves the cutting ability of the bit 10.

Figure 2:
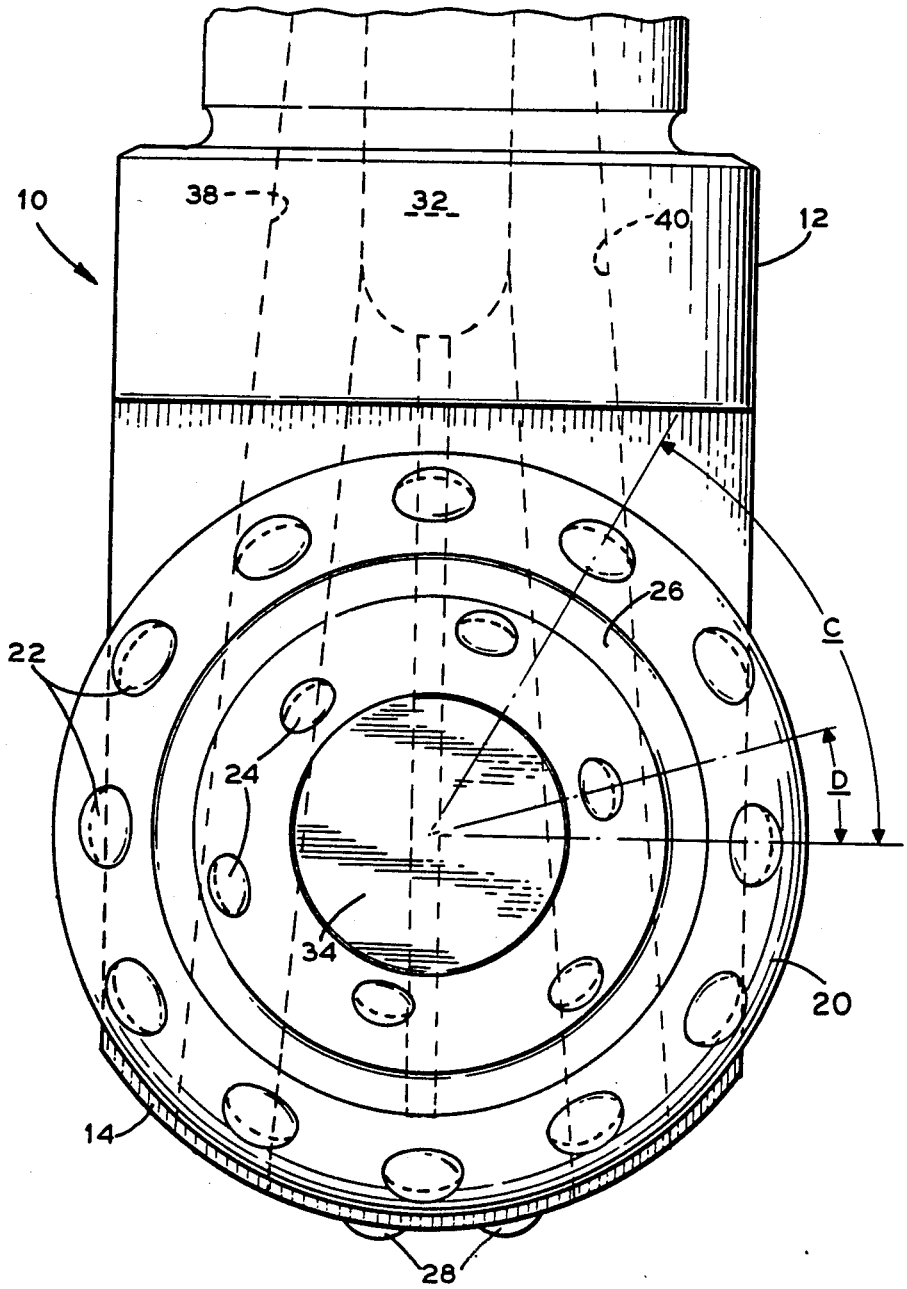
FIG. 2 is a view taken along line 2—2 in FIG. 1.
Figure 3:
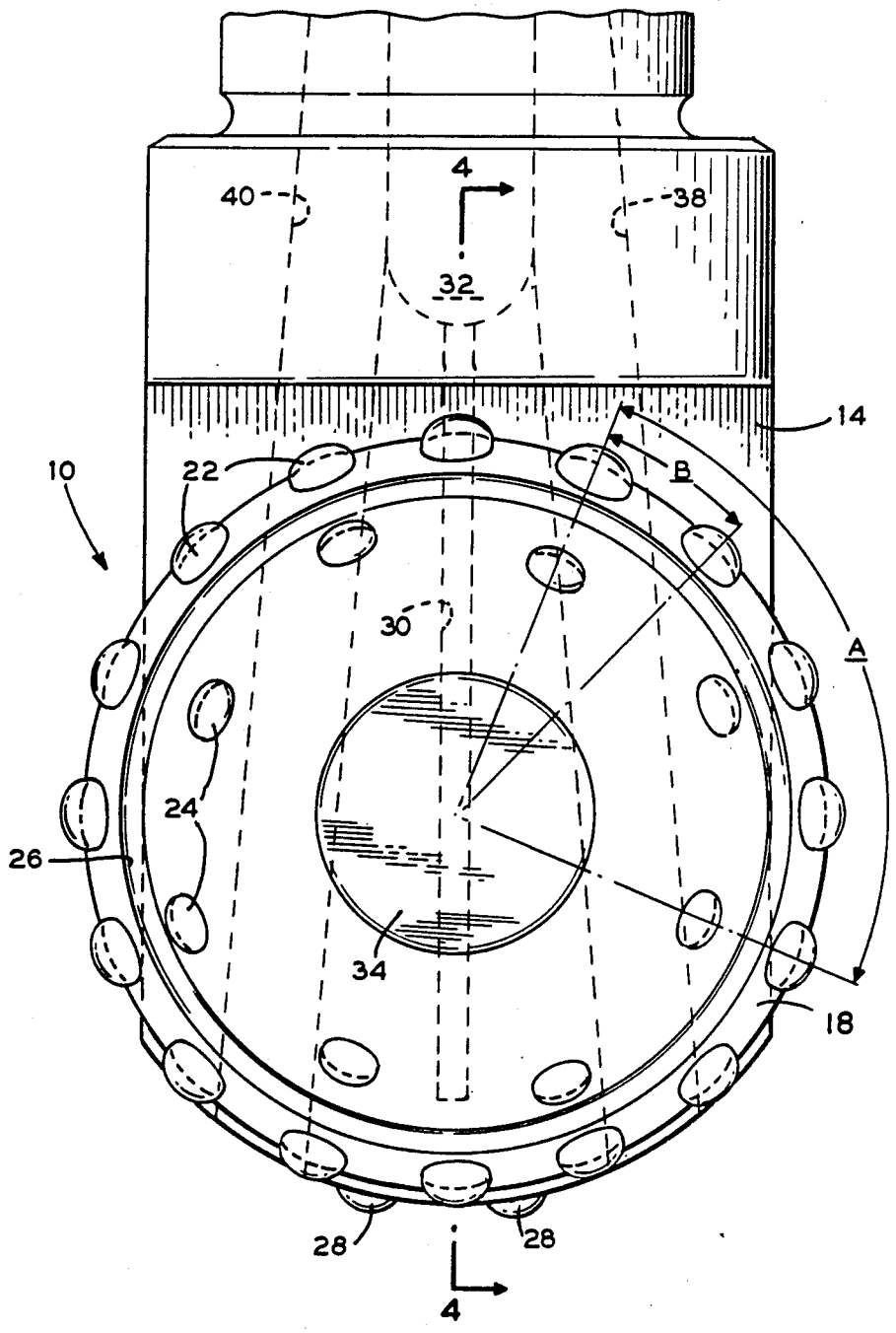
FIG. 3 is a view taken along line 3—3 in FIG. 1.

FIGS. 2 and 3 depict left and right side views of the bit 10 respectively. Conduits 38 and 40 carry high pressure oil charged air to the base of the bit 10 to clear the cuttings from the bit 10 when the bit 10 is cutting. See FIG. 5.

Figure 5:
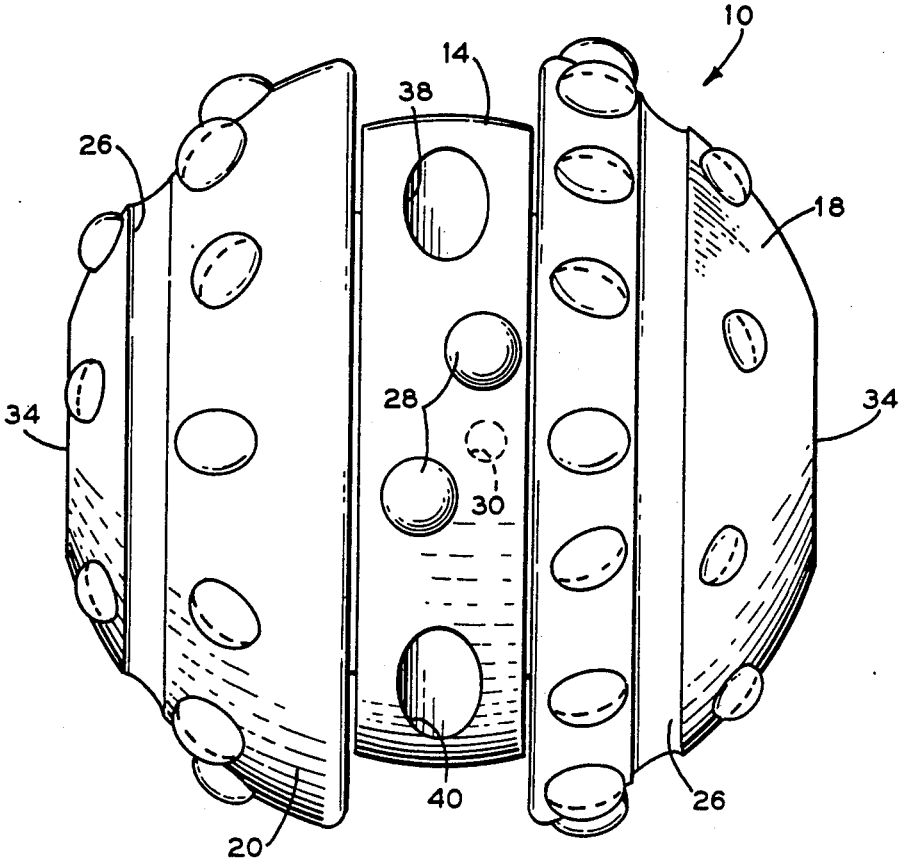
FIG. 5 is a view taken along line 5—5 in FIG. 1.

FIG. 5 is a bottom view of the bit 10. Note the conduits 38 and 40 and the fixed cutters 28 at the base of the tongue 14.

Figure 6:
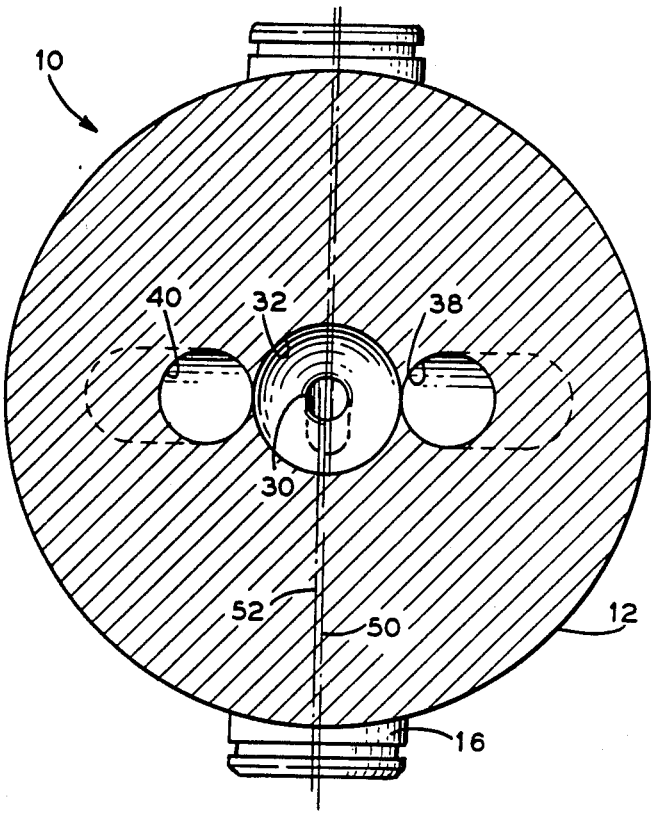
FIG. 6 is a cross-sectional plan view of an embodiment of the invention.

FIG. 6 is a plan view of the bit 10 without the semi-spheres 18 and 20. Numeral 50 represents the offset axis of symmetry of the shaft 16 whereas numeral 52 reprsents the axis of symmetry of the bit 10. The two axis of symmetry 50 and 52 are offset by a predetermined distance to forwardly bias the cutting (front) face of the bit 10.

The invention and the manner of applying it may, perhaps, be better understood by a brief discussion of the principles underlying the invention. Quantities and physical dimensions are presented but it should be understood that the numbers are for illustrative purposes only and are not to be contrued as limiting.

The bit 10 may be made from two seven inch (17.78 cm) diameter semi-spheres 18 and 20. Semi-sphere 18 includes sixteen ⅝-inch (1.59 cm) diameter cutters 22 and eight ½ inch (1.27 cm) diameter cutters 24. Semi-sphere 20 includes twelve ⅝-inch diameter cutters 22 and six ½-inch diameter cutters 24. The cutters 28 are ⅝-inch in diameter.

In the center of the shank 12, the central journal 30 is ¼ inches (0.64 cm) in diameter. The conduits 38 and 40 are 13/16 inches (2.06 cm) in diameter and continue throughout the tongue 14. The oilers 42 and 44 are 1/16 inches (0.16 cm) in diameter.

It is preferred to offset the two semi-spheres 18 and 20 on the bit 10. Referring again to FIG. 6, it may be observed that the shaft 16 (or the axis of symmetry 52) is offset 1/32 of an inch (0.08 cm) from the axis of symmetry 50 of the bit 10. This small forward bias causes the leading or cutting faces of the semi-spheres 18 and 20 and, as a consequence, the cutters 22 and 24 to more fully contact the ground to be drilled. By the same token, it also allows the trailing faces of the semi-spheres 18 and 20 and the cutters 22 and 24 a small amount of room away from the hole to clear the cuttings. The bias results in lower forces needed to rotate the bit and, as a result, less wear on the cutters 22 and 24.

Accordingly, drilling efficiencies are improved and costs are reduced. For example, in the embodiment depicted, the entire bit 10 diameter is $7\frac{1}{4}$ inches (18.42 cm). With the 1/32 inch (1.08 cm) bias, the hole diameter would be 7.3125 inches (18.57 cm) $[7\frac{1}{4}+2\times(1/32)]$, which is slightly larger than the bit diameter. This state of affairs forces the bit 10 forward and leaves a relief at the back of the bit 10. Indeed, without the forward bias, the bit 10 may try to screw itself into the ground and cease to rotate. In any event, it is preferred to expose as many cutters 22 and 24 to the ground being drilled as possible. It is theorized that the larger cutters 22 break the earth, and the smaller cutters 24 clean the cuttings away. In the embodiment shown, about twenty-three of cutters 22 and 24 are always contacting the work face. Cutters 28 assist in the drilling operation.

The staggering of the cutters 22 and 24 about the semi-spheres 18 and 20 improves the cutting efficiency of the bit 10. As the biased bit 10 rotates there is a continuous wiping action along the entire surface of the hole being drilled. It is preferred to stagger the cutters 22 and 24 so that they will not track in a groove previously made by another cutter. Rather, the cutters 22 and 24 will continuously break the rock in the hole. Similarly, by utilizing an unequal number of cutters 22 and 24, the breaking action of the bit 10 is increased.

As a consequence, it is preferred to assymetrically place the grooves 26 on different planes on the semi-spheres 18 and 20 to accomodate the staggered cutters 22 and 24 and prevent erosion of the semi-spheres 18 and 20. The cutters 22 on semi-sphere 20 will tend to track in the "wake" of the groove 26 on semi-sphere and the cutters 24 on semi-sphere 18 will tend to track in the "wake" of the groove 26 on semi-sphere 20 as the bit 10 rotates.

The cutters 22, 24 (and 28) fracture the ground and are disposed across the semi-spheres 18 and 20 at various angles. The angles, which are a function of the size of the size of the semi-spheres 18 and 20, are selected in such a manner so that when the bit 10 has made several revolutions, the cutters will have contacted the hard ground across the entire cutting face of the bit. In the embodiment shown, angle "A" is 90 degrees; angle "B" is 22 degrees, 30 minutes; angle "C" is 60 degrees; and angle "D" is 15 degrees. The location and number of the cutters 22 and 24 will affect semi-sphere 18 and 20 rotational speed. Both the angles and the staggered array of the cutters contribute to the improved cutting efficiency of the bit 10.

During drilling operations, oil-charged air is transmitted through the drill string to the bit 10. The oil mixture is forced through the conduits 38 and 40 and out to the work area to both lubricate the cutting surface of the bit 10 and carry away the cuttings. Additionally, some of the oil collects in the reservoir 32. As the oil collects therein, it is forced by the air pressure through the central journal 30 into oilers 42 and 44 and passages 54 and 56 to lubricate the bearings 46 (or bushings) and the thrust washers 48.

In use, the bit 10 would preferably be utilized with two other major components. An in-the-hole ("ITH") drill (not shown) applies a continuous down pressure (on the order of 2000–3000 psi [8896.44–13344.66N]) and rotational movement to the drill rods and pipes disposed between the drill and bit 10. A percussion hammer (not shown), disposed above the bit 10, imparts dynamic impact forces to the shank 12 of the bit 10 which in turn transfers the forces to the cutters 22, 24 and 28. Through the combination of the hammer impacting and the bit rotating under pressure, the cutters 22, 24 and 28 fracture and clear pieces of material (cuttings) from the hard ground.

An air source supplies pressurized air to the ITH drill. Mixed with oil, the air is forced down through the center of the drill pipe. The air causes the percussion hammer to operate. Exhaust air from the hammer is then directed to the bit 10. The air courses through the bit 10 and is exhausted at the base of the bit 10. A portion of the oil collects in the reservoir 32 and is forced into the interior of the bit 10. The air flow then proceeds to pick up the cuttings and carry them away from the bit 10 via grooves 26 and the cavity formed between the hole wall and the drill pipe.

It may be appreciated that the bit 10 may be utilized in all drilling applications; i.e., underground mines, open pits, oil fields etc. Indeed, the bit 10 may be used in place of drag and roller bits.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A spherical rotary bit, the bit comprising a shank and a tongue extending therefrom, a first axis of symmetry, a shaft disposed normally to the tongue, the shaft including a second axis of symmetry, a pair of semi-spheres rotatably affixed to the shaft and rotatable about the second axis of symmetry, each semi-sphere disposed on opposing sides of the tongue and substantially parallel with the tongue and one another, bearing means disposed between the shaft and the semi-spheres, means for supplying lubricant to the bearing means, fluid passageways extending through the tongue, an arcuate groove extending along the external surface of each semi-sphere and substantially parallel with the tongue, each groove not identically positioned on the semi-spheres, one semi-sphere including a first row of staggered cutters disposed on one side of its groove and second row of smaller staggered cutters on the other side of the groove, the remaining semi-sphere including a substantially straight third row of cutters disposed on one side of its groove and a fourth row of smaller staggered cutters on the other side of the groove, all of the cutters not identically situated in a corresponding location on the semi-spheres.

2. The bit according to claim 1 wherein the first axis of symmetry and the second axis of symmetry are not coincident so as to bias the semi-spheres in a determined direction.

3. The bit according to claim 1 wherein a lubricant reservoir is disposed within the shank, a journal extending therefrom through the tongue and communicating with the bearing means.

4. The bit according to claim 3 wherein the fluid passageways communicate with the reservoir and extend without the base of the tongue.

5. The bit according to claim 1 wherein cutters are disposed at the base of the tongue.

6. The bit according to claim 1 wherein roller bearings are disposed between the shaft and the semi-spheres.

* * * * *